US008141181B2

(12) United States Patent
Faulstich

(10) Patent No.: US 8,141,181 B2
(45) Date of Patent: Mar. 27, 2012

(54) NECK JET PILLOW FOR WHIRLPOOL TUB OR SPA

(75) Inventor: Michael Faulstich, Cedar Park, TX (US)

(73) Assignee: Aquatic Co., Anaheim, CA (US)

( * ) Notice: Subject to any disclaimer, the term of this patent is extended or adjusted under 35 U.S.C. 154(b) by 1135 days.

(21) Appl. No.: 11/950,163

(22) Filed: Dec. 4, 2007

(65) Prior Publication Data

US 2009/0139020 A1 Jun. 4, 2009

(51) Int. Cl.
*A47K 3/10* (2006.01)
*A61H 33/00* (2006.01)

(52) U.S. Cl. ..... 4/575.1; 4/541.6

(58) Field of Classification Search ..... 4/496, 559, 4/547, 571.1, 573.1, 575.1, 541.6; 601/148
See application file for complete search history.

(56) References Cited

U.S. PATENT DOCUMENTS

| | | | |
|---|---|---|---|
| 4,635,619 | A | 1/1987 | Diamond |
| 4,839,930 | A | 6/1989 | Watkins |
| 4,908,888 | A | 3/1990 | Watkins |
| 5,140,713 | A | 8/1992 | Pesterfield |
| D364,303 | S | 11/1995 | Larsen |
| 5,503,618 | A | 4/1996 | Rey |
| 5,546,616 | A | 8/1996 | Bloemer et al. |
| 5,548,854 | A | 8/1996 | Bloemer et al. |
| 5,617,591 | A | 4/1997 | Bloemer et al. |
| D380,041 | S | 6/1997 | Bengstson et al. |
| 5,682,625 | A | 11/1997 | Leaverton et al. |
| 5,928,171 | A | 7/1999 | Larsen |
| 6,186,964 | B1 | 2/2001 | Branham |
| 6,993,797 | B1 | 2/2006 | Yang |
| 2002/0053105 | A1 | 5/2002 | Turner |

*Primary Examiner* — David Dunn
*Assistant Examiner* — Danielle Jackson
(74) *Attorney, Agent, or Firm* — P. N. Dunlap, Esq.; J. A. Thurnau, Esq.; T. A. Dougherty, Esq.

(57) ABSTRACT

A neck jet pillow for a spa or whirlpool tub removably mountable. The pillow has a soft membrane area occupying a central portion thereof, a first mounting member fixedly mountable onto a fluid jet, a second mounting member fixedly attached to the pillow and slidably and removably mountable onto the first mounting member, and a hole in the second mounting member coinciding with the membrane area whereby the jet can direct a fluid stream onto the backside of the membrane area. The first and second mounting members, when mounted together and onto the pillow and jet, define a water-tight cavity there between having a jet inlet and a discharge opening whereby spent fluid from the jet is discharged downward into the tub or spa. The mounting members may be sliding members.

18 Claims, 2 Drawing Sheets

NECK JET PILLOW FOR WHIRLPOOL TUB OR SPA

BACKGROUND OF THE INVENTION

1. Field of the Invention

This invention relates generally to a neck jet pillow for a whirlpool tub or spa, more particularly to a neck jet pillow slidably mounted on a whirlpool jet, and specifically to a neck jet pillow slidably mounted on a jet and providing a dry neck massage.

2. Description of the Prior Art

Neck jet pillows for a whirlpool tub or spa which provide a therapeutic massage to a user's neck in conjunction with a water jet are known.

U.S. Pat. No. 5,617,591 to Bloemer et al. discloses a head rest assembly with a support bracket partially enclosed in the pillow for easy connection with a specially adapted dual jet nozzle assembly. The pillow includes a porous cover to dampen the force of the jets, thus providing a wet neck massage.

U.S. Pat. No. 5,928,171 to Larsen discloses a unitarily molded pillow having a flexible membrane mounted therein and an integrally molded support structure. The pillow is mounted to and through the tub wall with permanent fasteners, making it difficult or impossible to remove for cleaning. The membrane is non-porous to facilitate dry massage of the user's neck, but splash control relies on the support structure being closely conforming to the tub wall, including a plastic brace mounted on the tub to prevent deflection of the support structure and escape of water in undesirable directions.

SUMMARY

The present invention is directed to systems and methods which provide a neck jet pillow for a tub or spa which provides a dry neck massage to a human occupant. The invention further provides a pillow that is easily removable for cleaning or maintenance. The invention provides for convenient mounting of the pillow on a conventional tub or spa wall.

The present invention is directed to a neck jet pillow for a spa or whirlpool tub easily or readily and removably mountable onto at least one fluid jet. The neck jet pillow comprises a soft membrane area occupying a central portion thereof, a first mounting member fixedly mountable onto the jet, a second mounting member fixedly attached to the pillow and slidably and removably mountable onto the first mounting member, a hole in the second mounting member coinciding with the membrane area whereby the jet can direct a fluid stream onto the backside of the membrane area. The backside of the membrane area and the first and second members define there between a cavity with a discharge opening for discharging spent fluid from the cavity.

In one embodiment, the mounting members may be slidably mountable or slide members. In other embodiments, the mounting members may snap together or twist on or engage with a spring retaining mechanism or the like.

The opening may be a single opening on one edge of the cavity. Other than the opening, the cavity is substantially water-tight. The opening may discharge spent fluid downward into the tub or spa. The downward discharge may occur below the normal water level in the tub or spa.

The pillow may have a central aperture, with the membrane protruding through the aperture, and the membrane may be attached to the second mounting or slide member thereby sealing the hole in the second mounting or slide member and defining a portion of the cavity.

The mounting or slide members may be of rigid, structural material, the pillow of soft, foam material, and the membrane of relatively thin, non-porous, flexible material. The structural material may be plastic, PVC, or ABS. The foam material may be closed-cell polymeric foam and water proof, and the flexible material may be polymeric, elastomeric, or rubber. The membrane attachment to second member may be by means of adhesive or by mechanical attachment means or both. The second mounting or slide member may be attached to the pillow permanently by means of adhesive, weld, or mechanical attachment means.

The first mounting or slide member may have a hole to facilitate attachment to the jet and thereby to the tub or spa by means of the jet having a threaded body or other fastener or attachment device and a bulkhead flange, the body adapted to pass through the hole in first slide mount and a matching hole in a surface of the tub or spa. The flange may then be pulled tight against the first slide mount and thereby pulling the slide mount tight against the tub surface as the jet fastener or attachment means, such as a nut, is tightened onto the body. A gasket, O-ring or other sealing device may also be used.

The invention is also directed to a whirlpool tub or spa equipped with at least one fluid jet and with a neck jet pillow as described above.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, which are incorporated in and form part of the specification in which like numerals designate like parts, illustrate embodiments of the present invention and together with the description, serve to explain the principles of the invention. In the drawings.

DETAILED DESCRIPTION

Figure 1:
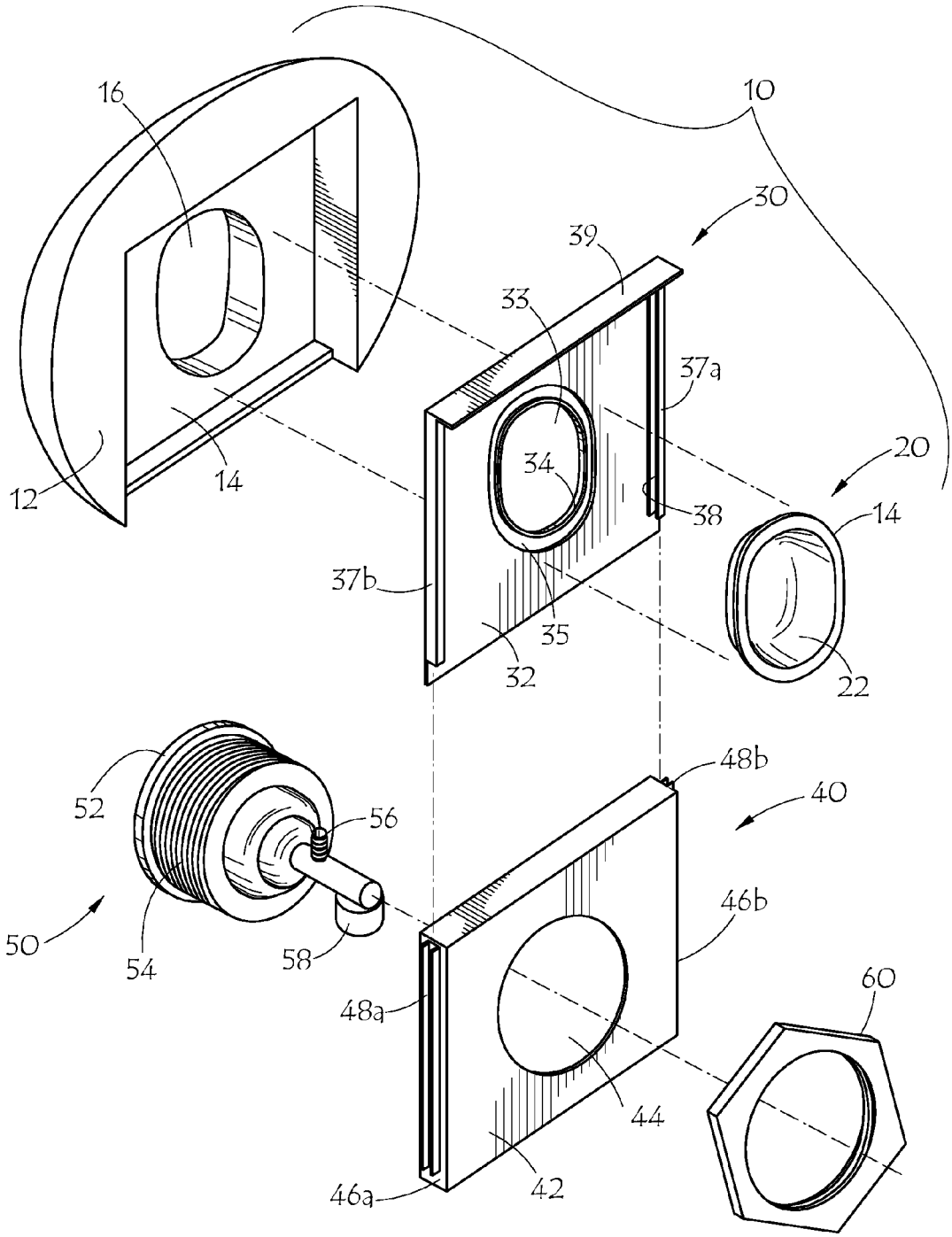
FIG. 1 is an exploded perspective view of an embodiment of the invention.

FIG. 1 shows an exploded view of a neck jet pillow for a spa or whirlpool tub according to an embodiment of the invention. Referring to FIG. 1, the neck jet pillow includes pillow member 12, membrane 20, first slide member 40 and second slide member 30. Fluid jet 50 may be used to fixedly attach first slide member 40 to a wall of a whirlpool tub or spa, not shown, by inserting jet body 54 through aperture 44 and through a matching aperture in the tub wall, not shown, and then fastening the jet body on the other side of the tub wall, for example, with nut 60 screwed onto threaded body 54. Thus, flange 52 on jet 50 may be pulled tight against first slide member 40, thus holding both jet and slide member firmly in place on the wall of the tub or spa. Membrane 20, second slide member 30 and pillow member 12 may be fixedly or permanently fastened together as indicated in FIG. 1 to form a pillow assembly, which may be slidably mounted onto the tub by sliding second slide member 30 down over first slide member 40. "Fixedly attached" herein means not easily removably during normal use or without damage, and may include permanent attachment, or integral construction. In contrast, the pillow is easily or readily removable from the tub or spa by means of the two-piece slide mount consisting of the first slide member and second slide member.

Pillow member 12 has a relatively soft, thin, flexible membrane area occupying a central portion thereof. The embodiment of FIG. 1 has a separate membrane 20 which fits into aperture 16 in the central portion of pillow member 12, thus forming the central soft membrane portion of pillow member 12. In another embodiment, the pillow and membrane may be integrally formed.

Second slide member 40 may be fixedly attached to the pillow so that member 40 resides in suitably formed recess 14 and so that pillow aperture 16 coincides with hole 33 in second slide member 30. Membrane 20 may be cup-shaped with rim 14. Hole 33 in second slide member 30 may have on its periphery ridge 34 and/or groove 35 for engaging rim 14 of membrane 20. Thus, when assembled, membrane 20 completely covers and seals hole 33 and protrudes through hole 33 into aperture 16 sufficiently for membrane 20 to become or form a portion, the missing portion, of the pillow surface, as shown more clearly in FIG. 2. Pillow assembly 10 is sized and shaped so that membrane 20 is in the position of a user's neck when the user's head is resting on the pillow. Thus, when fluid exits jet 52, it impinges on membrane 20 and the force of the fluid creates a massaging action which may be felt through the membrane by the neck of the user.

Slide members 30 and 40 are adapted to slidably engage. First slide member 40 has tongue and groove member 48*a* on one vertical side 46*a*, and matching tongue and groove member 48*b* on other vertical side 46*b*. Likewise, second slide member 30 has two matching tongue and groove members 37*a* and 37*b* on its respective vertical edges. Thus, second slide member 30 may be slid down onto first slide member 40, where it may be held in place by the tongue and groove sliding arrangement. The embodiment of FIG. 1 shows two tongues forming a single groove there between on each edge 46*a* and 46*b* of first slide member 40, and a single tongue 37*a* and 37*b* on each edge of second slide member 30 adapted to engage the grooves.

One skilled in the art could envision other functionally equivalent, readily removable, mounting arrangements whereby slide members 30 and 40 may be replaced by first and second mounting members which removably engage. For example, in another embodiment, a circular mechanism could be used so that the pillow is mounted by pushing and turning, for example a predetermined number of degrees or fraction of a circle, stopping in the proper final position. Such turning motion could be facilitated by mating threads on the two mounting members, or by tabs on one member and grooves on another. In other embodiments, a hinge-like attachment mechanism or a snap-on mechanism could be used, or a combination of sliding, hinging, or turning and snapping into position. Thus, pillow assembly 10 may be easily slid on and off or otherwise mounted and removed for purposes such as cleaning, adjusting, and/or maintaining of the pillow, tub wall, or jet.

When removably engaged or mounted together, a cavity or chamber is formed within the two mounting members. For example, in the embodiment of FIG. 1, main plate 42 of first slide member 40 forms the rear of a cavity. Main plate 32 of second slide member 30 along with backside 22 of membrane 20 forms the front of a cavity. Here, front and rear or back are used to represent position relative to a user of the pillow, so that front is closer to the user and rear is farther from the user. Thus, the front surface of the membrane may be touched by a user and the back surface of the membrane is generally not visible to a user. Referring again to the cavity formed between the mounting or sliding members, vertical side walls 46*a* and 46*b*, and/or various portions of the sliding mechanism 37*a*, 48*a* and 37*b*, 48*b* form the sides of the cavity. The top of the cavity is formed by top plate 39 on one or both of the sliding members. Aperture 44 is sealed by jet 50 and jet flange 52. Thus, the cavity may be substantially water-tight on all sides except for a portion left intentionally open whereby spent fluid from the fluid jet may exit the cavity to return to the tub or spa. Thus, the embodiment shown in the figures has a cavity with no bottom wall, leaving an opening at the bottom of the cavity, or along the bottom edge of the cavity, for discharging spent fluid from the cavity. Thus, by having a water-tight cavity and controlled discharge through a discharge opening, undesirable splashing is minimized or prevented.

Figure 2:
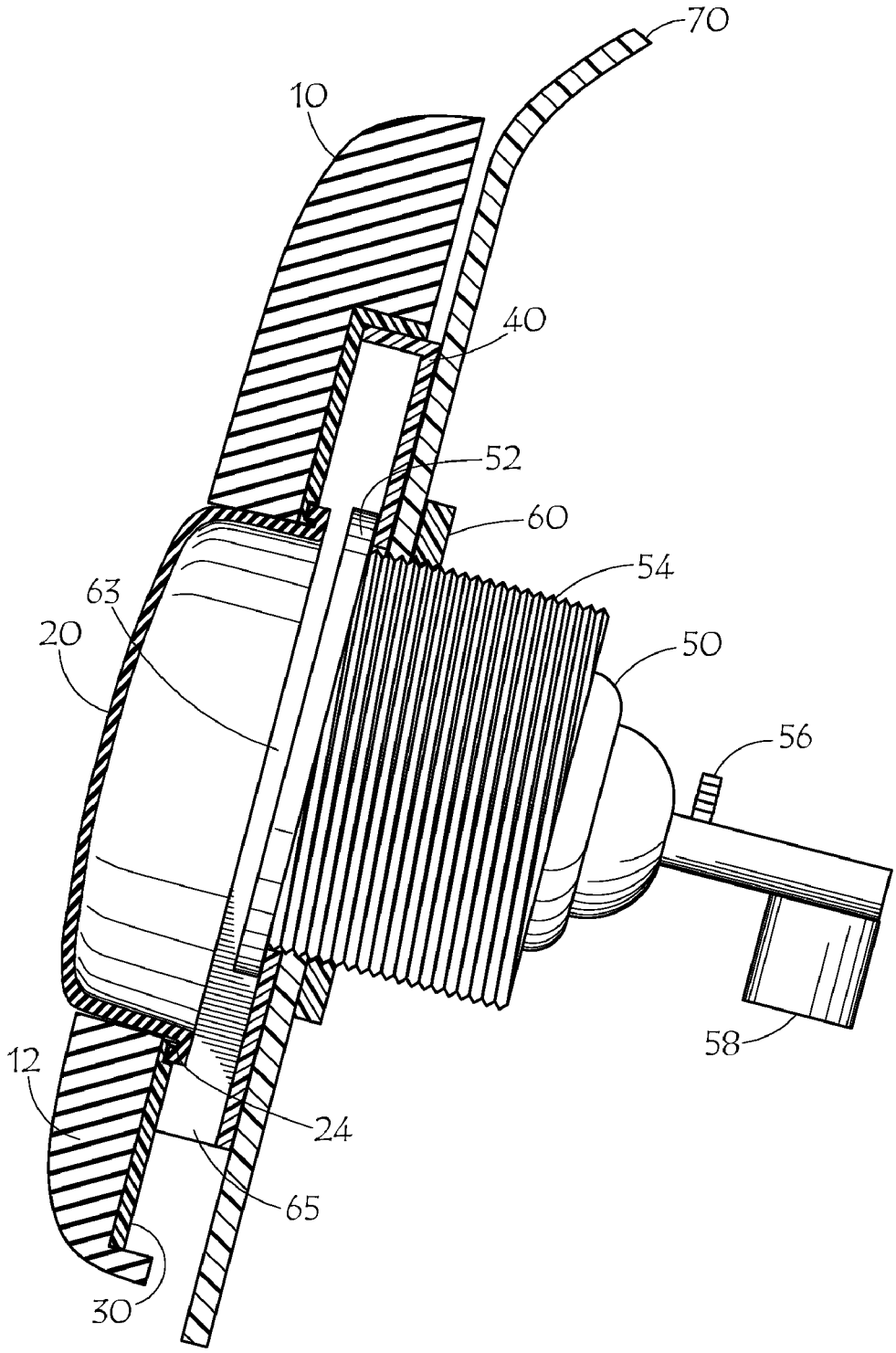
FIG. 2 is a partially fragmented side view, with parts in section, of a mounted pillow assembly according to an embodiment of the invention.

FIG. 2 shows the embodiment of FIG. 1 assembled and mounted on a tub or spa wall in partially fragmented, partially sectional, side view. Referring to FIG. 2, tub wall 70 has a hole matching the aperture in first sliding member 40 through both of which jet 50 protrudes. Nut 60 is tightened onto threaded jet body 54 pulling flange 52, first sliding member 40, and tub wall 70 tightly together. Second sliding member 30 is fixedly attached to the back side of pillow member 12. Membrane 20 is attached to second sliding member 30 at joint 24. Membrane 20 also protrudes into pillow member 12 and forms the central portion of the pillow surface for massaging a user's neck. Thus, pillow member 12, membrane 20, and second sliding member 30 form pillow assembly 10. The two sliding members 30 and 40, along with the back side of membrane 20, define cavity 63 and discharge opening 65. Cavity 63 is substantially water-tight except for discharge opening 65. Thus, splashing of water in unwanted directions is prevented.

The neck jet pillow embodiment of FIGS. 1 and 2 shows a cavity discharge opening that can discharge spent fluid downward into the tub or spa. Alternate arrangements are possible where the opening discharges fluid from the cavity in some other direction, but generally downward or downward angled discharge is advantageous for returning fluid to the tub or spa and for avoiding unwanted splashing out of the tub or onto the head of a user. The generally downward discharge from the opening may occur below the normal water level in the tub or spa to further reduce splashing. The downward discharge from the opening may be adapted to produce a pleasing effect on a user's shoulders, back, or other body part.

The neck jet pillow embodiment of FIG. 1 shows multi-piece pillow assembly 10. Although an integrally formed pillow of a single material is possible, use of multiple pieces made of multiple materials may provide for advantageous functionality of the individual components. For example, the mounting members may be formed of a rigid, structural material while the pillow may be formed of a soft or firm foam material, and the membrane may be of relatively thin, non-porous, flexible material. The rigid structural material for the mounting members may be, for example, metal or composite or a plastic such as PVC or ABS. The foam material for the pillow may be a water-proof, closed-cell polymeric foam, and the flexible membrane material may be polymeric, elastomeric, or rubber. Textile or fiber reinforcement may be used in one or more of the component materials as needed.

The various parts of the neck jet pillow may be joined together by various fastening means. For example, the membrane attachment to the second mounting or sliding member may be by means of adhesive and/or by mechanical attachment means. Likewise, the second sliding member may be joined to the pillow member by adhesive, weld, mechanical fasteners, and/or the like.

The neck jet pillow embodiment of FIG. 1 shows first slide member 40 attached to jet 50 and thereby to the tub or spa by means of threaded body 54 and flange 52 in the form of a bulkhead flange. Other means of attachment may readily be envisioned, such as adhesion, welding, clip, or other mechanical attachment device. Also, various sealing methods may be included including gaskets, o-rings, sealants and the like as needed.

The invention is also directed to a whirlpool tub or spa equipped with a neck jet pillow as described above. The pillow of the present invention does not require a special recess or fitting in or on the tub or spa wall as required in some prior art designs, but may be adapted to mount on almost any jet having a bulkhead flange style of attachment to a tub wall. However, the tub wall should not have any obstruction above the jet that would interfere with removal of the pillow. Just as a bulkhead fitting, such as flange 52 on jet 50, requires a flat wall in the vicinity of a fitting mounting hole for optimum sealing, in the same way, the embodiment of the invention illustrated in the figures, having a first mounting or slide member 40 that is substantially flat or planar, works best in terms of optimum sealing if the tub wall is flat in the vicinity of the jet mounting hole, and preferably, if the tub wall is flat over the area covered by the first mounting or slide member. The first mounting member could be molded or formed with some curvature in order to accommodate mounting on a tub wall having curvature on either side of a flat jet mounting area. Likewise it is contemplated that the pillow and/or second slide mount shape(s) could be adjusted to accommodate tub curvature. The present invention can provide a dry neck massage in any tub or spa in which it is properly mounted, because splash or water flow control is provided solely by the pillow assembly, independent of the design of the tub or spa wall. The spa or tub may be further equipped with one or more additional jets, lights, circulation means, heater, ozonator, filling or draining means, controls, and the like.

In use, the function of an embodiment of the present invention may be described with reference to the figures. A water supply or water circulation system, not shown, may be attached to water port 58 of jet 50. In addition, an air source, atmospheric or pressurized, may be attached to air port 56. A typical fluid jet for a spa or whirlpool tub may thus provide a mixture of air and water, via jet 50, which will impinge a stream of fluid on membrane 20. The fluid force on the membrane will provide a massaging effect on any body part adjacent the membrane, typically the neck of the user. The water/air mixture will then exit cavity 63 via discharge opening 65, which may be below normal water level in the tub or spa. The jet itself may be a single fixed jet, a rotating or oscillating jet, a pulsating jet, multiple jets, or the like. The jet may be adjustable. A common adjustable jet requires reaching into the outlet of the jet in order to adjust the flow rate, air/water mix, and/or direction. An advantage of the inventive pillow over some prior art designs is the ease with which the pillow can be fully or partially removed to permit a user to adjust the jet. For the embodiment of the figures, pillow assembly 10 can be simply slid upward part way or removed to permit a user to adjust the jet.

Although the present invention and its advantages have been described in detail, it should be understood that various changes, substitutions, and alterations can be made herein without departing from the spirit and scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A neck jet pillow for a jetted spa or whirlpool tub with at least one fluid jet comprising:

a pillow member comprising a soft membrane area occupying a central portion thereof, a first mounting member fixedly mountable onto said jet, a second mounting member fixedly attached to the pillow and readily and removably mountable onto said first mounting member while said first mounting member is fixedly mounted onto said jet, a hole in said second mounting member coinciding with said membrane area whereby said jet can direct a fluid stream onto the backside of said membrane area, said backside of said membrane area and said first and second mounting members defining a cavity there between with a jet inlet and a discharge opening; and wherein said discharge opening is a single opening at an edge of said cavity and said cavity is otherwise substantially water-tight.

2. The neck jet pillow of claim 1 wherein said opening discharges fluid downward into the tub or spa.

3. A neck jet pillow for a jetted spa or whirlpool tub with at least one fluid jet comprising:

a pillow member comprising a soft membrane area occupying a central portion thereof, a first mounting member fixedly mountable onto said jet, a second mounting member fixedly attached to the pillow and readily and removably mountable onto said first mounting member while said first mounting member is fixedly mounted onto said jet, a hole in said second mounting member coinciding with said membrane area whereby said jet can direct a fluid stream onto the backside of said membrane area, said backside of said membrane area and said first and second mounting members defining a cavity there between with a jet inlet and a discharge opening; and wherein said pillow has an aperture, said membrane protrudes through said aperture, and said membrane is attached to said second mounting member thereby sealing said hole.

4. A neck jet pillow for a jetted spa or whirlpool tub with at least one fluid jet comprising:

a pillow member comprising a soft membrane area occupying a central portion thereof, a first slide member fixedly mountable onto said jet, a second slide member fixedly attached to the pillow and slidably and removably mountable onto said first slide member while said first slide member is fixedly mounted onto said jet, a hole in said second slide member coinciding with said membrane area whereby said jet can direct a fluid stream onto the backside of said membrane area, said backside of said membrane area and said first and second members defining a cavity there between with a jet inlet and a discharge opening; and wherein said discharge opening is a single opening on one edge of said cavity and said cavity is otherwise substantially water-tight.

5. The neck jet pillow of claim 4 wherein said opening discharges fluid downward into the tub or spa.

6. The neck jet pillow of claim 5 wherein said downward discharge occurs below the normal water level in the tub or spa.

7. The neck jet pillow of claim 4 wherein said pillow has an aperture, said membrane protrudes through said aperture, and said membrane is attached to said second member thereby sealing said hole.

8. The neck jet pillow of claim 7 wherein said membrane attachment to second member is by means of adhesive or by mechanical attachment means or both.

9. The neck jet pillow of claim 4 wherein said slide members are of rigid, structural material; said pillow is of soft, foam material; and said membrane is of relatively thin, non-porous, flexible material.

10. The neck jet pillow of claim 9 wherein said structural material is plastic, PVC, or ABS; said foam material is closed-cell polymeric foam and water proof; and said flexible material is polymeric, elastomeric, or rubber.

11. The neck jet pillow of claim 4 wherein said second slide member is attached to said pillow permanently by means of adhesive, weld, or mechanical attachment means.

12. The neck jet pillow of claim 4 wherein said first slide member has a hole and is attached to said jet and thereby to said tub or spa by means of said jet having a threaded body and a bulkhead flange, said threaded body adapted to pass through said hole in first slide member and a matching hole in a surface of said tub or spa, said flange being pulled tight against said first slide mount and thereby said slide member being pulled tight against said surface as a nut is tightened onto said threaded body.

13. A neck jet pillow system comprising a neck jet pillow and a neck jet;

said pillow comprising:

pillow member comprising a soft membrane area occupying a central portion thereof, a first mounting member fixedly mountable onto said jet, a second mounting member fixedly attached to the pillow and readily and removably mountable onto said first mounting member while said first mounting member is fixedly mounted onto said jet, a hole in said second mounting member coinciding with said membrane area whereby said jet can direct a fluid stream onto the backside of said membrane area, said backside of said membrane area and said first and second mounting members defining a cavity there between with a jet inlet and a discharge opening; and said jet comprising a bulkhead fitting comprising a flange and a fastener; and wherein said discharge opening is a single opening on one edge of said cavity adapted to discharge fluid downward into the tub, and said cavity is otherwise substantially water-tight.

14. A whirlpool tub or spa comprising:

a tub wall;

at least one jet mountable to the tub wall; and a neck jet pillow comprising:

a pillow member comprising a soft membrane area occupying a central portion thereof, a first mounting member fixedly mountable onto said jet, a second mounting member fixedly attached to the pillow and readily and removably mountable onto said first mounting member while said first mounting member is fixedly mounted onto said jet and while said jet is fixedly mounted onto said tub wall, a hole in said second mounting member coinciding with said membrane area whereby said jet can direct a fluid stream onto the backside of said membrane area, said backside of said membrane area and said first and second mounting members defining a cavity there between with a jet inlet and a discharge opening; and wherein said discharge opening is a single opening on one edge of said cavity adapted to discharge fluid downward into the tub, and said cavity is otherwise substantially water-tight.

15. The tub of claim 14 wherein said first and second mounting members are first and second slide members.

16. The tub of claim 15 wherein said pillow has an aperture, said membrane protrudes through said aperture, and said membrane is attached to said second member thereby sealing said hole.

17. The tub of claim 16 wherein said downward discharge occurs below the normal water level in the tub or spa.

18. The tub of claim 14 wherein said first mounting member has a jet hole, said tub wall has a matching hole, and said jet has a body adapted to pass through said jet hole and matching hole, a bulkhead flange, and a attachment device adapted to engage said body and to hold said flange, first mounting member and said tub wall tightly together.

* * * * *